US009370289B2

(12) United States Patent
Kauffman

(10) Patent No.: US 9,370,289 B2
(45) Date of Patent: Jun. 21, 2016

(54) FLOOR SCRUBBER AND SCRUBBER HEAD

(71) Applicant: Pacific Steamex Cleaning Systems, Inc., Muskegon, MI (US)

(72) Inventor: Kipling J. Kauffman, Zeeland, MI (US)

(73) Assignee: Pacific Steamex Cleaning Systems, Inc., Muskegon, MI (US)

( * ) Notice: Subject to any disclaimer, the term of this patent is extended or adjusted under 35 U.S.C. 154(b) by 17 days.

(21) Appl. No.: 14/564,811

(22) Filed: Dec. 9, 2014

(65) Prior Publication Data

US 2015/0096133 A1 Apr. 9, 2015

Related U.S. Application Data

(63) Continuation of application No. 14/046,243, filed on Oct. 4, 2013.

(60) Provisional application No. 61/709,786, filed on Oct. 4, 2012.

(51) Int. Cl.

| | |
|---|---|
| ***A47L 11/40*** | (2006.01) |
| ***A47L 11/12*** | (2006.01) |
| ***A47L 11/28*** | (2006.01) |
| ***A47L 11/282*** | (2006.01) |

(52) U.S. Cl.

CPC ..... *A47L 11/282* (2013.01); *A47L 11/4038* (2013.01)

(58) Field of Classification Search

CPC ..... A47L 11/02; A47L 11/12; A47L 11/125; A47L 11/28; A47L 11/284; A47L 11/4036; A47L 11/4038; A47L 11/408; A47L 11/4088

USPC ..... 15/98, 49.1, 50.1, 50.2, 52.2

See application file for complete search history.

(56) References Cited

U.S. PATENT DOCUMENTS

| | | | | |
|---|---|---|---|---|
| 1,566,371 | A | 12/1925 | Brownrig | |
| 2,506,077 | A * | 5/1950 | Goldsmith | 15/322 |
| 3,655,444 | A * | 4/1972 | Young | A47L 11/12 134/6 |
| 3,657,759 | A * | 4/1972 | Sawyer | A47L 11/125 15/98 |
| 5,587,021 | A | 12/1996 | Hoersch et al. | |

(Continued)

FOREIGN PATENT DOCUMENTS

DE 2078496 A 1/1982

OTHER PUBLICATIONS

Tennant Co. Parts Manual for T3 floor scrubber, believed to be dated Jun. 2013.

Adfinity Advance 17ST/20ST floor scrubber Parts List, believed to be dated Sep. 2007.

Clarke Focus II floor scrubber Operator's Manual, believed to be dated Apr. 2010.

(Continued)

*Primary Examiner* — Monica Carter
*Assistant Examiner* — Stephanie Berry
(74) *Attorney, Agent, or Firm* — Gardner, Linn, Burkhart and Flory, LLP

(57) ABSTRACT

A floor scrubber with a floor scrubber head having a backing plate to which a pad is secured with the pad adapted to being placed in contact with a surface to be cleaned. The scrubber head includes a motor support to which a motor is mounted with the backing plate being secured to the motor support, with the motor configured to move the backing plate and pad when cleaning a surface. The scrubber head further includes a cover member having an opening through which the motor extends, with the cover member further including a pair of wheels with an outer perimeter of the wheels partially extending beyond a periphery of the cover member.

21 Claims, 6 Drawing Sheets

(56) References Cited

U.S. PATENT DOCUMENTS

| | | | | |
|---|---|---|---|---|
| 5,964,003 | A | 10/1999 | Rogers | |
| 6,450,867 | B1 * | 9/2002 | Legatt | A47L 11/162 451/350 |
| 7,900,873 | B2 * | 3/2011 | Kulesha | B64C 27/001 188/379 |
| 8,234,749 | B2 | 8/2012 | Mitchell et al. | |
| 2006/0150362 | A1 * | 7/2006 | Mitchell | A47L 11/305 15/320 |
| 2008/0271757 | A1 * | 11/2008 | Mitchell | 134/21 |

OTHER PUBLICATIONS

Clarke Focus II Compact Autoscrubbers brochure, believed to have been publicly available more than one year prior to Oct. 4, 2012.

Tomcat Edge Surface Preparation Technology floor scrubber and stripper brochure, believed to have been publicly available more than one year prior to Oct. 4, 2012.

Pacific Floor Care Z Series automatic floor scrubber brochure, published more than one year prior to Oct. 4, 2012.

Pacific Floor Care Z210 floor scrubber manual, published more than one year prior to Oct. 4, 2012.

* cited by examiner

FLOOR SCRUBBER AND SCRUBBER HEAD

CROSS REFERENCE TO RELATED APPLICATION

The present application is a continuation of U.S. application Ser. No. 14/046,243, filed on Oct. 4, 2013, which claims priority of U.S. provisional application Ser. No. 61/709,786 filed on Oct. 4, 2012, by Kipling J. Kauffman for FLOOR SCRUBBER AND SCRUBBER HEAD, which are hereby incorporated herein by reference in their entireties.

BACKGROUND OF THE INVENTION

The present invention is directed to a floor scrubber and a scrubber head for a floor scrubber.

Floor scrubbers are used to clean floor surfaces and include a scrubber head that may be positioned against the floor to provide scrubbing action on the floor. An operator may walk behind the floor scrubber, with the scrubber head being movable between a raised orientation for transporting the floor scrubber when not being used for cleaning, and the noted cleaning orientation in which the scrubber head is positioned against the floor.

Different types of scrubber heads may be mounted to a floor scrubber, including a rotary scrubber head in which the pad is circularly rotated against the floor surface and an orbital scrubber head in which the pad is moved against the floor in an eccentric manner without completely spinning. In the case of orbital scrubber heads, cleaning fluid is conventionally discharged directly onto the floor surface in front of the advancing scrubber head. The cleaning fluid is then worked against the floor surface by the pad of the scrubber head.

SUMMARY OF THE INVENTION

The present invention provides a floor scrubber and a scrubber head for a floor scrubber.

According to an aspect of the present invention, a floor scrubber includes a scrubber head comprising a pad for contacting a floor surface to be cleaned, a pad mounting plate to which the pad is mounted, and an applicator for discharging cleaning fluid, with the applicator arranged whereby cleaning fluid discharged from the applicator is directed at and discharged onto the pad.

In particular embodiments the applicator comprises an elongate distribution conduit and includes a plurality of orifices aimed at the pad, such as at a top surface of the pad. Still further, the front edge of the mounting plate may be inwardly disposed from the front edge of the pad relative to the scrubber head to provide an exposed portion of the pad, wherein the applicator is arranged such that cleaning fluid discharged from the applicator is directed at and discharged onto the exposed portion of the pad.

The scrubber head in accordance with the present invention promotes the entrainment of fluid within the scrubbing pad and avoids applying fluid directly onto the floor surface, thus inhibiting the creation of puddles on the floor surface when the floor scrubber is in operation.

These and other objects, advantages, purposes and features of this invention will become apparent upon review of the following specification in conjunction with the drawings.

DESCRIPTION OF THE PREFERRED EMBODIMENTS

The present invention will now be described with reference to the accompanying figures, wherein the numbered elements in the following written description correspond to like-numbered elements in the figures. A floor scrubber 30 with an orbital scrubber head 200 for cleaning floors is shown in FIG. 1, where floor scrubber 30 is an operator walk-behind type scrubber having forward wheels 34 and rear wheels 36 for supporting movement of scrubber 30 on a floor, as well as various tanks for providing cleaning fluid and suctioning and retaining used fluid from the floor.

Figure 1:
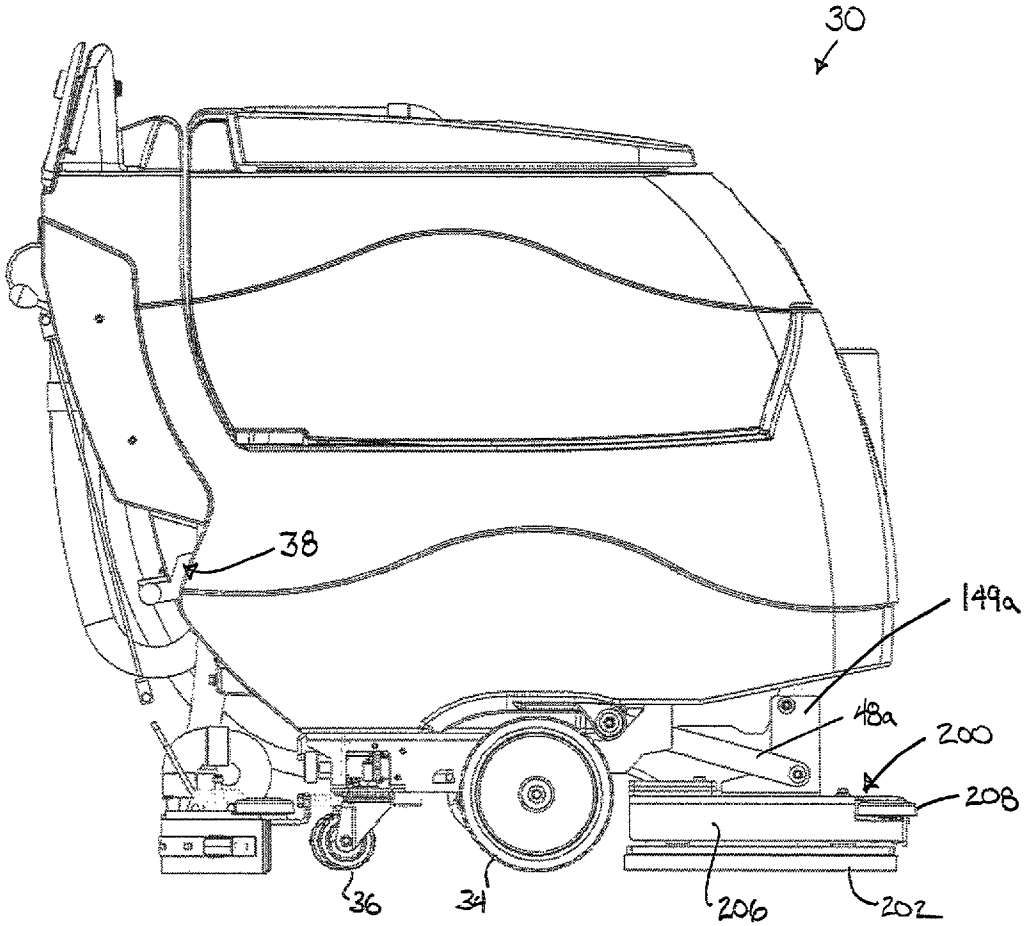
FIG. 1 is a side elevation view of a floor scrubber with an orbital scrubber head in accordance with an aspect of the present invention.

Scrubber head 200 is affixed to scrubber 30 via head arms, with only head arm 48*a* shown in FIG. 1. As discussed in detail below, head 200 includes a pad 202 and a fluid applicator or applicator system 204 (FIG. 3), where applicator 204 is configured to distribute or apply cleaning fluid directly onto pad 202 rather than onto a floor surface located in front of pad 202. Pad 202 is porous such that the fluid is retained within pad 202, thereby providing more effective cleaning of a floor surface relative to conventional systems in which fluid is dropped or applied in front of or in advance of the head. The pads of such conventional systems tend to plow or spread the cleaning fluid, including dispersing portions to one or both sides of the pad, thereby wasting fluid and reducing cleaning.

Figure 2:
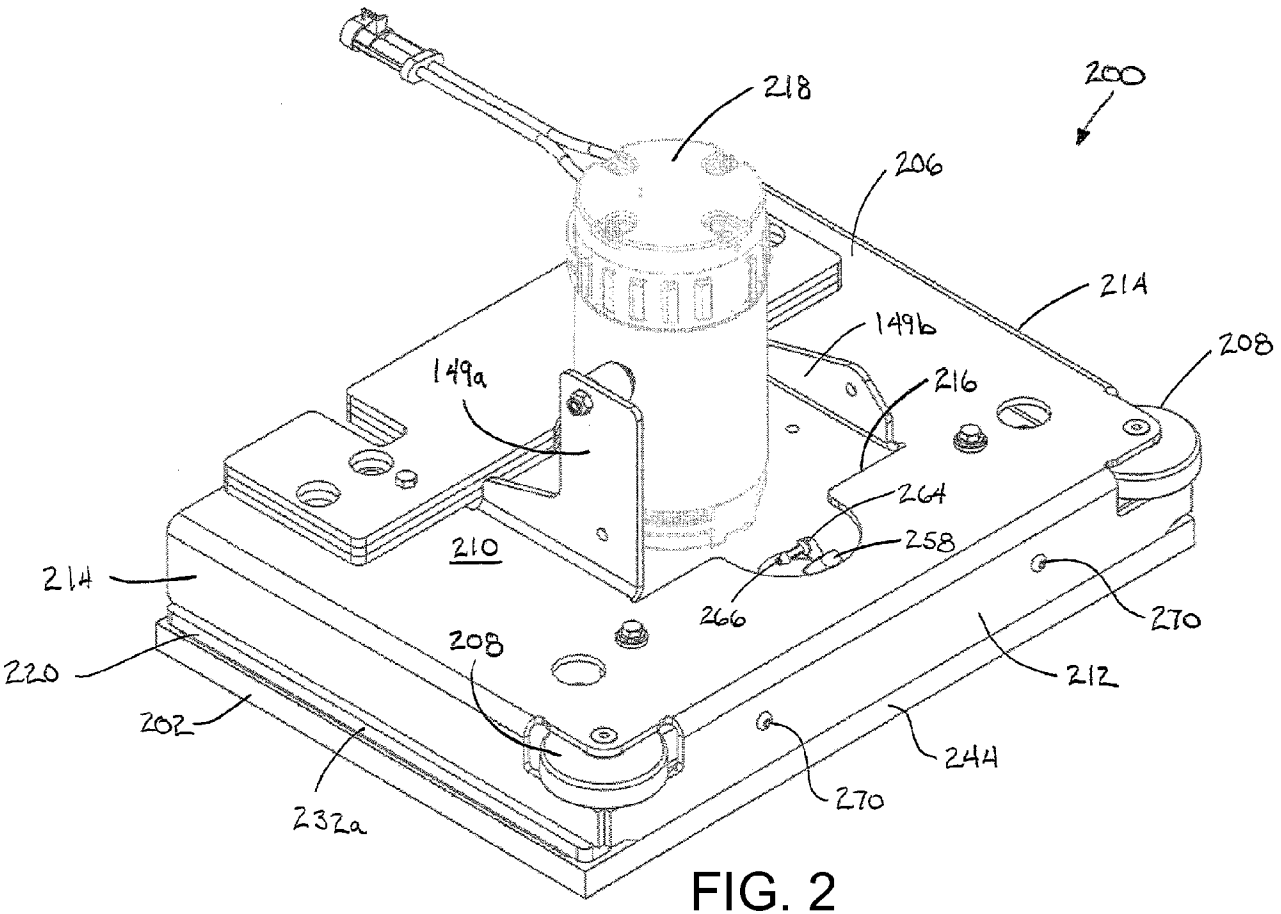
FIG. 2 is a front perspective view of the orbital scrubber head of FIG. 1 removed from the floor scrubber.
Figure 3:
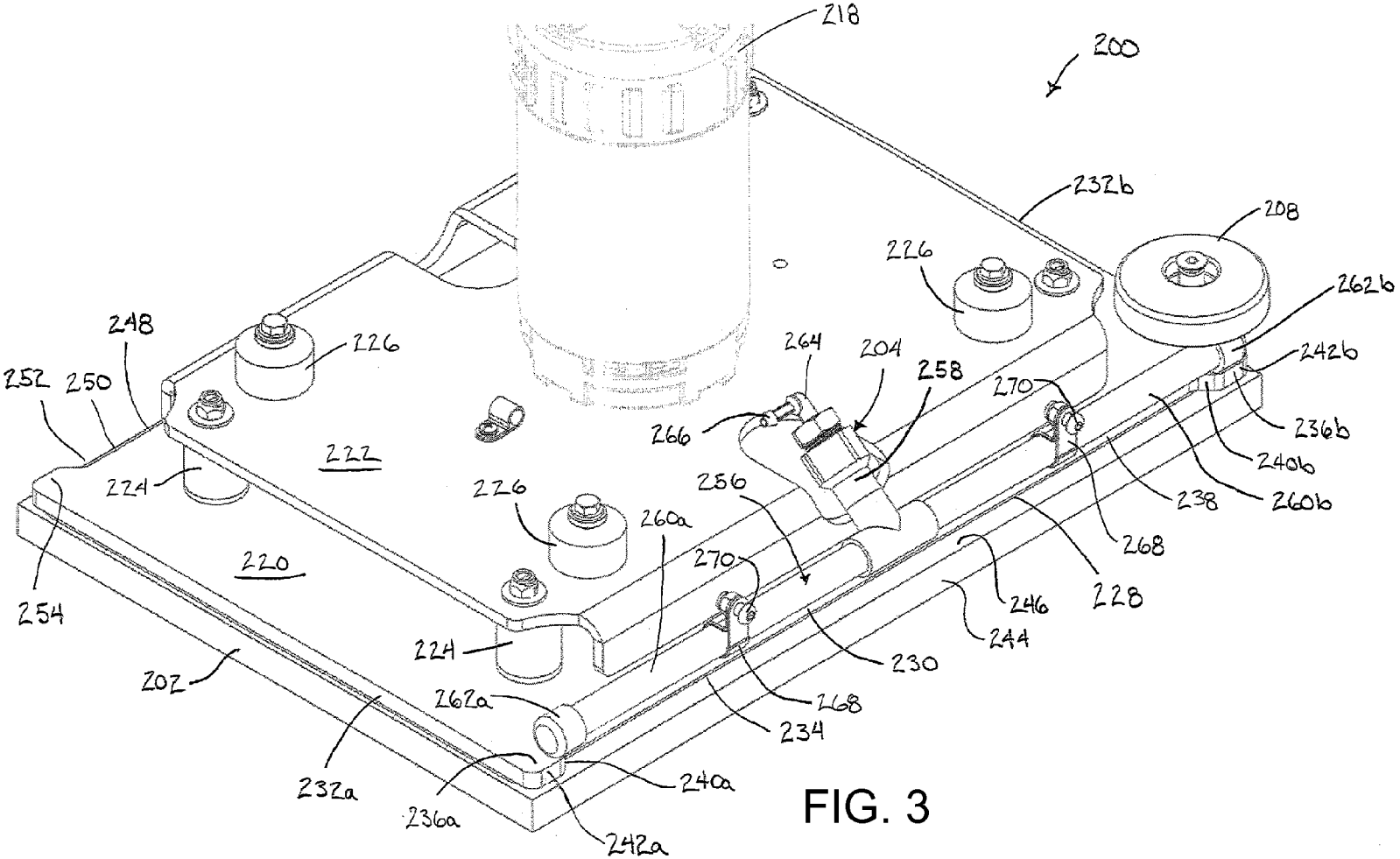
FIG. 3 is a front perspective view of the orbital scrubber head of FIG. 2 with a cover member removed for clarity, but with one of the cover mounted guide wheels shown for relative orientation illustrative purposes.

Referring to FIG. 2 of the disclosed embodiment, head 200 includes a cover 206 having a pair of mounting flanges 149*a*, 149*b* for receiving head arms 48*a*, 48*b* from adjustment assembly 38, and guide wheels 208 that are mounted to cover 206 for aiding movement of head 200 adjacent a vertical surface. Cover 206 includes a planar top member 210, with a front member 212 and side members 214 (one shown in FIG. 2) depending downwardly from top member 210. As shown in FIGS. 1-6, wheels 208 are mounted at the front corners of cover 206 with an upwardly oriented axis of rotation and with the outer diameter of wheels 208 extending outwardly beyond the periphery of cover 206, such as beyond planes defined by front member 212 and side members 214. Cover 206 further includes an opening 216 through which motor 218 extends. With reference to FIG. 3, head 200 further includes a pad mounting plate or backing plate 220 to which pad 202 is secured, as well as a motor support or mounting plate 222, where pad plate 220 is secured to motor plate 222 by way of mounts 224 and motor plate 222 is secured to cover 206 by way of mounts 226, where mounts 224, 226 comprise vibration isolating mounts. In one embodiment, the mounts 226 are constructed of a higher durometer material than mounts 224 to minimize the vibrations that are transmitted upward and maximize the vibrations that are transmitted downwards to the surface that is being cleaned. When either of wheels 208 contacts a vertical surface, such as when head 200 is brought adjacent a wall adjacent a floor surface that is being cleaned, the force of any such impact is absorbed by being transferred to and through cover 206 due to the mounting of wheels 208 to cover 206. In particular, the force is transferred to head arms 48*a*, 48*b* from mounting flanges 149*a*, 149*b* and, thereby, to scrubber 30 itself. Notably, the impact force is not transferred to mounts 224, 226.

Pad plate 220 has an end 228 positioned adjacent applicator 204 where end 228 comprises a front end in the installed orientation shown in FIGS. 3-6 relative to the forward motion of scrubber 30 when in use. Front end 228 includes a front edge 230 extending between side edges 232*a*, 232*b* of plate 220, with front edge 230 defining a recess or cavity 234 and a pair of extending portions that are formed as tabs 236*a*, 236*b* such that recess 234 extends between tabs 236*a*, 236*b*. Front edge 230 comprises a central front edge portion 238, angled edge portions 240*a*, 240*b* and leading edge portions 242*a*, 242*b*, where recess 234 is defined by central front edge portion 238 and angled edge portions 240*a*, 240*b*. As understood from FIGS. 3, 5 and 6, pad 202 is mounted to pad plate 202 such that a front edge 244 of pad 202 extends beyond front edge 230 of pad plate 202. For example, central front edge portion 238 may be recessed from front edge 244 of pad 202 by approximately 0.5 inches. Front edge 230 and recess 234 thus expose a portion of pad 202, including upper portion 246 of pad 202 between tabs 236*a*, 236*b*.

Pad plate 220 also has an end 248 opposite end 228, where in the embodiment shown end 248 is substantially identical to end 228 as including an edge 250 defining a cavity or recess 252 and extending projections 254 (one shown in FIG. 3). Accordingly, pad plate 220 may be installed in an opposite orientation relative to that shown in the various views such that applicator 204 is positioned adjacent end 248 whereby end 248 would operate as the front end when scrubber 30 is in use.

With reference to FIGS. 3-7, applicator 204 is shown to include a distribution conduit 256 having a fitting 258, where fitting 258 is joined to a cleaning fluid delivery line (not shown) that provides cleaning fluid from a tank of scrubber 30 to applicator 204. Conduit 256 includes a pair of tubes or pipes 260*a*, 260*b*, with fitting 258 comprising a T-fitting and tubes 260*a*, 260*b* being connected thereto at one end with caps 262*a*, 262*b* affixed to tubes 260*a*, 260*b* at their opposite ends. Fitting 258 includes an elbow fitting 264 having a flared end 266 to which the cleaning fluid delivery line is connected. Applicator 204 is connected with head 200 by way of a pair of clamps 268 that are affixed to cover 206 by fasteners 270.

Figure 4:
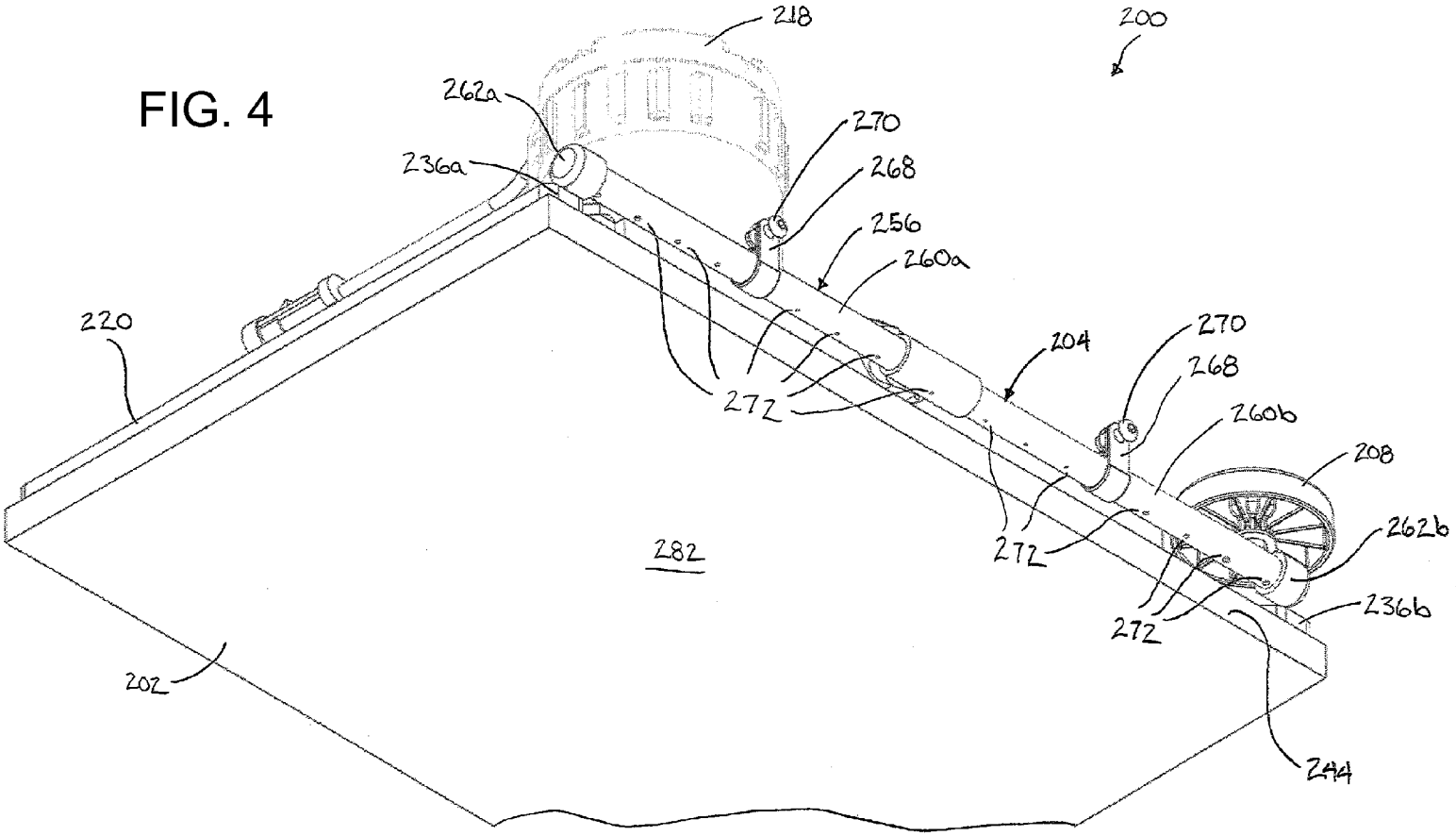
FIG. 4 is a bottom perspective view of the orbital scrubber head arrangement of FIG. 3.

With reference to FIG. 4, conduit 256 further includes multiple nozzles or orifices 272 out of which cleaning fluid is distributed. In the illustrated embodiment orifices 272 are formed as holes in the undersides of tubes 260*a*, 260*b* and fitting 258, with the diameters of orifices 272 increasing in size from the fitting 258 toward caps 262*a*, 262*b* to provide consistent fluid flow out of orifices 272 as the cleaning fluid travels along tubes 260*a*, 260*b*.

Figure 5:
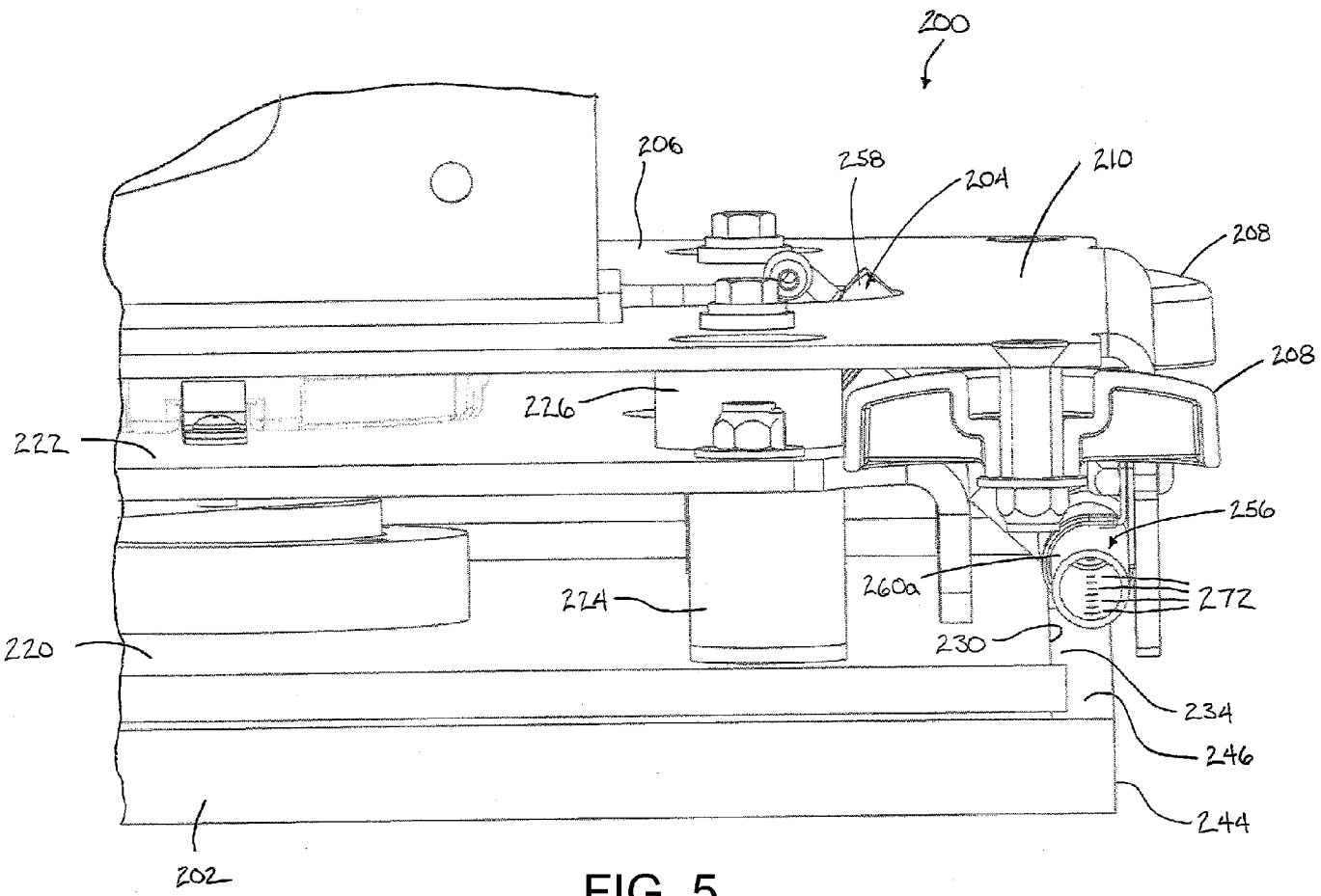
FIG. 5 is a side sectional perspective view of the orbital scrubber head of FIG. 2.
Figure 6:
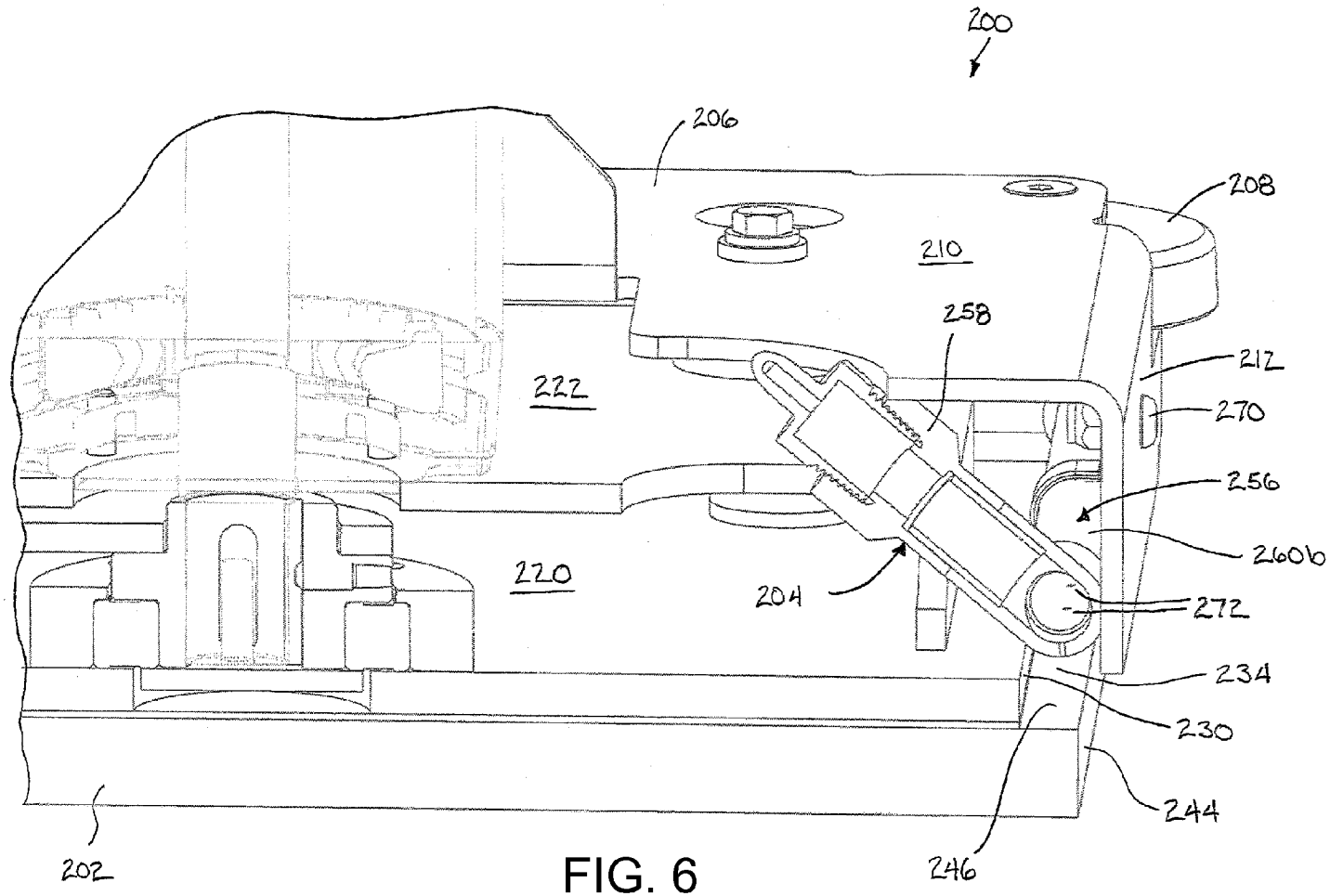
FIG. 6 is an alternative side sectional perspective view of the orbital scrubber head of FIG. 2.

As understood with reference to FIGS. 5 and 6, orifices 272 are oriented such that cleaning fluid output from the orifices 272 is distributed substantially directly onto pad 202. That is, rather than discharging cleaning fluid onto the floor in advance or in front of head 200, cleaning fluid is caused to be directly distributed or applied onto portion 246 of pad 202. In the illustrated embodiment this is achieved by mounting tubes 260*a*, 260*b* above recess 234 with orifices 272 being aligned to distribute or apply cleaning fluid generally vertically downward onto portion 246 of pad 202. Distributing or applying the cleaning fluid onto pad 202 promotes entrainment of the fluid within the porous pad 202, with the cleaning fluid then flowing through the pad and to the pad underside 282. As such, the formation of puddles or pools of cleaning fluid on a floor are inhibited, including inhibiting the formation of such puddles that may be formed on either side of a cleaning head as the head would otherwise plow through cleaning fluid deposited on the floor in advance of a forward moving floor scrubber.

It should be appreciated that alternatively configured cleaning heads may be constructed in accordance with the present invention relative to head 200. Including, for example, with regard to the arrangements, configurations and mounting orientation of the various members, such as the cover, pad backing plate, motor mounting plate, and applicator assembly. Scrubber 30 may also include a head adjustment assembly 38 (FIG. 1) for adjusting the position of head 200, such as disclosed in U.S. provisional patent application Ser. No. 61/709,786, to which the present application claims priority.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A floor scrubber, said floor scrubber comprising:
wheels for movably supporting said floor scrubber;
a base assembly; and
a scrubber head;
said scrubber head comprising a backing plate to which a pad is secured with said pad adapted to being placed in contact with a surface to be cleaned, said scrubber head further comprising a motor support to which a motor is mounted with said backing plate being secured to said motor support by a plurality of lower vibration isolator mounts connected to and disposed between said backing plate and said motor support, and wherein said motor is configured to move said backing plate and said pad when cleaning a surface, and wherein said scrubber head further comprises a cover member, said cover member being secured to said motor support by a plurality of upper vibration isolator mounts connected to and disposed between said motor support and said cover member, with said motor support disposed between said backing plate and said cover member and with said cover member including an opening through which said motor extends, and with said cover member further including a pair of scrubber head wheels with vertically oriented axes of rotations and with an outer perimeter of said scrubber head wheels at least partially extending beyond a periphery of said cover member and configured to guide movement of the scrubber head adjacent a vertical surface.

2. The floor scrubber of claim 1, wherein the durometer of said vibration isolator mounts securing said motor support to said cover member is higher than the durometer of said vibration isolator mounts securing said backing plate to said motor support.

3. The floor scrubber of claim 1, wherein said cover member includes a top member and a generally vertically oriented front member depending from said top member, wherein said opening is formed in said top member and wherein said front member is positioned adjacent a front edge of said pad, and wherein said scrubber head includes an applicator for discharging cleaning fluid, said applicator being disposed under said cover member adjacent said front member.

4. The floor scrubber of claim 3, wherein said cover member further includes a pair of generally vertically oriented side members, and wherein an outer perimeter of said scrubber head wheels of said cover member partially extend beyond planes defined by said side members and said front member.

5. The floor scrubber of claim 1, wherein said scrubber head further includes a pair of mounting flanges extending from said cover member with said opening disposed between said mounting flanges, and wherein said floor scrubber further includes a pair of arms with said arms being releasably connectable to said scrubber head.

6. A scrubber head for a floor scrubber, said scrubber head comprising:

a backing plate to which a pad is secured with said pad adapted to being placed in contact with a surface to be cleaned;

a motor support to which a motor is mounted with said backing plate being secured to said motor support by a plurality of lower vibration isolator mounts connected to and disposed between said backing plate and said motor support, and wherein said motor is configured to move said backing plate and said pad when cleaning a surface; and a cover member, said cover member being secured to said motor support by a plurality of upper vibration isolator mounts connected to and disposed between said motor support and said cover member, with said motor support disposed between said backing plate and said cover member and with said cover member including an opening through which said motor extends, and with said cover member further including a pair of wheels with vertically oriented axes of rotations and with an outer perimeter of said wheels at least partially extending beyond a periphery of said cover member and configured to guide movement of the scrubber head adjacent a vertical surface.

7. The scrubber head of claim 6, wherein said motor support comprises a generally planar plate member.

8. The scrubber head of claim 7, wherein said plurality of upper vibration isolator mounts and said plurality of lower vibration isolator mounts are connected to said motor support proximate a peripheral edge of said motor support.

9. The scrubber head of claim 6, wherein the durometer of said upper vibration isolator mounts securing said motor support to said cover member is higher than the durometer of said lower vibration isolator mounts securing said backing plate to said motor support.

10. The scrubber head of claim 6, wherein said upper vibration isolator mounts and said lower vibration isolator mounts are cylindrical, with said upper vibration isolator mounts being shorter and having a larger diameter than said lower vibration isolator mounts.

11. The scrubber head of claim 6, wherein said cover member includes a top member and a generally vertically oriented front member depending from said top member, wherein said opening is formed in said top member and wherein said front member is positioned adjacent to and extends parallel with a front edge of said pad, and further including an applicator for discharging cleaning fluid, said applicator being disposed under said cover member adjacent said front member.

12. The scrubber head of claim 11, wherein said applicator comprises a conduit, and wherein said conduit includes a plurality of orifices aimed at said pad.

13. The scrubber head of claim 11, wherein said cover member further includes a pair of generally vertically oriented side members, and wherein an outer perimeter of said wheels of said cover member partially extend beyond planes defined by said side members and said front member.

14. The scrubber head of claim 6, wherein said scrubber head further includes a mounting flange extending from said cover member, said mounting flange configured to enable said scrubber head to be connected with a floor scrubber.

15. The scrubber head of claim 14, wherein said scrubber head includes a pair of mounting flanges extending from said cover member, and wherein said opening in said cover member is disposed between said mounting flanges.

16. The scrubber head of claim 6, wherein said cover member includes a top member, and wherein said top member extends approximately the entire width and length of said pad whereby said pad is substantially enclosed by said cover member.

17. The scrubber head of claim 16, wherein said cover member includes a generally vertically oriented front member depending from said top member, wherein said front member is positioned adjacent to and extends parallel with a front edge of said pad, and further including an applicator for discharging cleaning fluid, said applicator being disposed under said cover member adjacent said front member.

18. The scrubber head of claim 17, wherein said cover member further includes a pair of generally vertically oriented side members, and wherein the outer perimeter of said wheels partially extends beyond planes defined by said side members and said front member.

19. The scrubber head of claim 16, further including a pair of mounting flanges extending from said top member, and wherein said opening in said top member is disposed between said mounting flanges.

20. The scrubber head of claim 7, wherein said cover includes a top member, a generally vertically oriented front member depending from said top member and a pair of generally vertically oriented side members, and wherein said top member extends approximately the entire width and length of said pad whereby said pad is substantially enclosed by said cover member.

21. The scrubber head of claim 20, further including a pair of mounting flanges extending from said top member, and wherein said opening in said top member is disposed between said mounting flanges.

* * * * *